US006907925B2

(12) United States Patent
Cote

(10) Patent No.: US 6,907,925 B2
(45) Date of Patent: Jun. 21, 2005

(54) PC PUMP INLET BACKWASH METHOD AND APPARATUS

(76) Inventor: Sheldon Cote, Suite 300, 400-5th Avenue SW, Calgary, Alberta (CA), T2P 0L6

( * ) Notice: Subject to any disclaimer, the term of this patent is extended or adjusted under 35 U.S.C. 154(b) by 69 days.

(21) Appl. No.: 10/395,869

(22) Filed: Mar. 20, 2003

(65) Prior Publication Data

US 2004/0026077 A1 Feb. 12, 2004

(30) Foreign Application Priority Data

Mar. 20, 2002 (CA) ..... 2377631

(51) Int. Cl.[7] ..... E21B 43/00
(52) U.S. Cl. ..... 166/68.5; 166/105; 418/48
(58) Field of Search ..... 417/405, 406, 417/408, 409; 418/48; 166/68, 68.5, 105, 105.1, 105.4

(56) References Cited

U.S. PATENT DOCUMENTS 3,443,482 A * 5/1969 Lummus et al. ..... 418/48
4,397,619 A * 8/1983 Alliquander et al. ..... 418/48
4,614,232 A * 9/1986 Jurgens et al. ..... 166/105.5
4,923,376 A 5/1990 Wright
5,090,497 A 2/1992 Beimgraben et al.
5,799,733 A * 9/1998 Ringgenberg et al. ..... 166/264

* cited by examiner

*Primary Examiner*—Kenn Thompson
(74) *Attorney, Agent, or Firm*—Christensen O'Connor Johnson Kindness PLLC

(57) ABSTRACT

A downhole moineau pump assembly includes a stator with a rotor extending through the stator. The rotor and stator sealingly engage each other at spaced intervals to form a series of annular spaces. A primary inlet is provided for fluids to enter a first of the series of annular spaces. A surface mounted top drive unit rotates the rotor. As the rotor rotates, fluids are drawn through the primary inlet and up the series of annular spaces between the rotor and the stator. A portion of the rotor is hollow with a central flow passage extending from a secondary inlet spaced from the primary inlet to the primary inlet. A portion of the fluids being pumped to surface are diverted into the secondary inlet and pumped under pressure down the central flow passage of the rotor to the primary inlet, thereby washing accumulated solids form the primary inlet.

3 Claims, 2 Drawing Sheets

PC PUMP INLET BACKWASH METHOD AND APPARATUS

FIELD OF THE INVENTION

The present invention relates to downhole moineau pump assembly used on producing oil wells.

BACKGROUND OF THE INVENTION

A downhole moineau pump assembly used on a producing oil well consists of a stator, a rotor that extends through the stator, and a surface mounted top drive unit that rotates the rotor. The rotor and stator sealingly engage each other at spaced intervals to form a series of annular spaces. As the rotor rotates, fluids are drawn through an inlet and up the series of annular spaces between the rotor and the stator.

In oil wells with high solids content, the downhole moineau pump assembly periodically ceases to function due to a build up of solids blocking the inlet.

SUMMARY OF THE INVENTION

What is required is a downhole moineau pumping assembly which has means for reducing or eliminating solids accumulations blocking the inlet.

According to the present invention there is provided a downhole moineau pump assembly which includes a stator with a rotor extending through the stator. The rotor and stator sealingly engage each other at spaced intervals to form a series of annular spaces. A primary inlet is provided for fluids to enter a first of the series of annular spaces. A surface mounted top drive unit rotates the rotor. As the rotor rotates, fluids are drawn through the primary inlet and up the series of annular spaces between the rotor and the stator. A portion of the rotor is hollow with a central flow passage extending from a secondary inlet spaced from the primary inlet to the primary inlet. Means is provided for diverting a portion of the fluids being pumped to surface into the secondary inlet and pumping them under pressure down the central flow passage of the rotor to the primary inlet thereby washing accumulated solids from the primary inlet.

With the downhole moineau pump assembly, as described above, a portion of the fluids being pumped to surface are diverted through the secondary inlet and pumped under pressure down the central flow passage of the rotor to wash solids away from the primary inlet. This continual washing of solids away from the primary inlet reduces, if not eliminating entirely, blockages of the primary inlet due to accumulated solids.

There are various technologies suitable for use in pumping them under pressure down the central flow passage of the rotor to the primary inlet to achieve the desired washing action. Beneficial results have been obtained through the use of an "orbiting" drive in which the secondary inlet has a plurality of radially extending forwardly angled vanes. As the rotor rotates the rotary motion of the vanes exert pressure to direct fluids into the secondary inlet. This form of orbiting drive is preferred as it does not need a separate power source. The rotational motion of the rotor is converted by the vanes of the orbiting drive into a pumping force.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
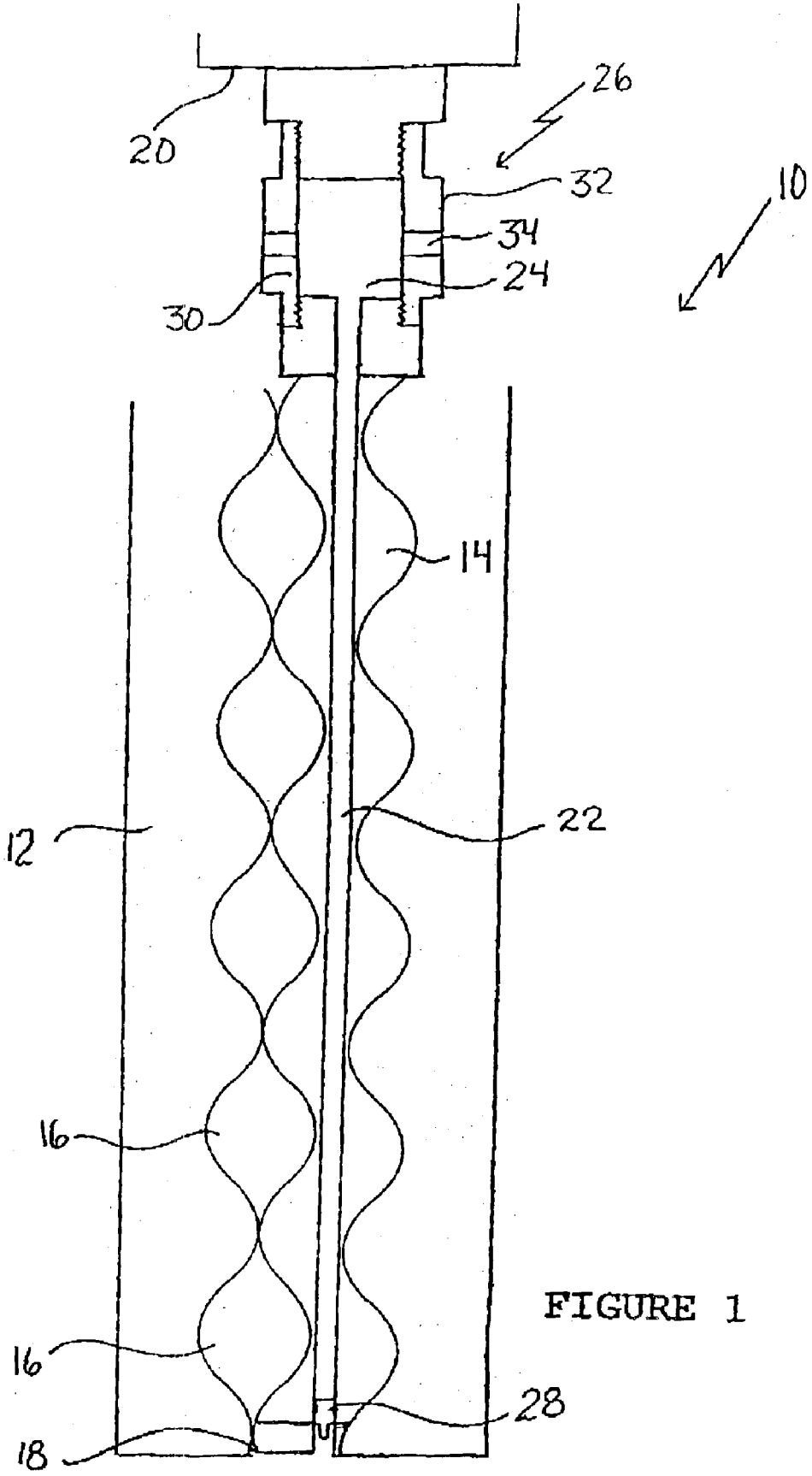
FIG. 1 is a side elevation, in section, of a downhole moineau pump assembly constructed in accordance with the teachings of the present invention.

The preferred embodiment, a downhole moineau pump assembly generally identified by reference numeral 10, will now be described with reference to FIGS. 1 and 2.

Structure and Relationship of Parts:

Referring to FIG. 1, pump assembly 10 includes a stator 12. A rotor 14 extends through stator 12. Rotor 14 and stator 12 sealingly engaging each other at spaced intervals to form a series of annular spaces 16. A primary inlet 18 is provided for fluids to enter a first of series of annular spaces 16. A surface mounted top drive unit 20 rotates rotor 14 such that, as rotor 14 rotates, fluids are drawn through primary inlet 18 and up series of annular spaces 16 between rotor 14 and stator 12. A portion of rotor 14 is hollow with a central flow passage 22 extending from a secondary inlet 24 spaced from primary inlet 18, to primary inlet 18.

An orbiting drive 26 is provided for diverting a portion of fluids being pumped up through series of annular spaces 16 into secondary inlet 24 and pumping them under pressure down central flow passage 22 of rotor 14. Fluids exit central flow passage through high pressure nozzle 28 that is proximate to primary inlet 18.

Figure 2:
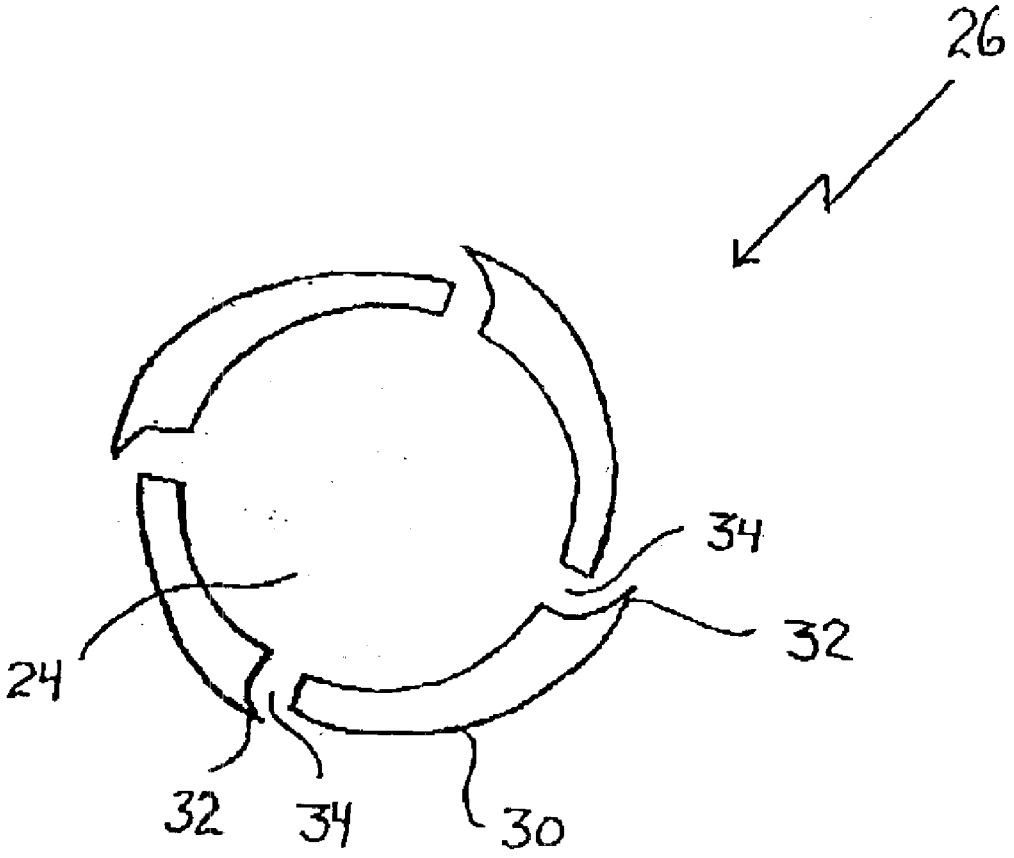
FIG. 2 is a top plan view, in section, of the orbiting drive of the downhole moineau pump assembly illustrated in FIG. 2.

Referring to FIG. 2, orbiting drive 26 has a peripheral wall 30 which defines secondary inlet 24. Orbiting sub 26 has a plurality of radially extending forwardly angled vanes 32, such that as rotor 14 rotates, the rotary motion of vanes 32 exert pressure to direct fluids through ports 34 in wall 30 in orbiting drive 26 and into secondary inlet 24.

Operation:

The use and operation of downhole moineau pump assembly generally identified by reference numeral 10, will now be described with reference to FIGS. 1 and 2. Referring to FIG. 1, downhole moineau pump assembly 10 is provided as described above. As rotor 14 rotates, fluids are drawn through primary inlet 18 and up series of annular spaces 16 between rotor 14 and the stator 12. Referring to FIG. 2, rotary motion of vanes 32 exerts pressure to direct fluids through ports 34 and into secondary inlet 24. Referring to FIG. 1, fluids pumped under pressure down central flow passage 22 of rotor 14 and out through high pressure nozzle 28 serve to wash solids away from primary inlet 18 to reduce or eliminate blockages of primary inlet 18 due to accumulated solids.

The form of orbiting drive 26 in the illustrated embodiment is preferred as it does not need a separate power source. The rotational motion of rotor 14 is converted by vanes 32 of orbiting sub 26 into a pumping force.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A moineau pump assembly, comprising:

a stator;

a rotor extending through the stator, the rotor and stator sealingly engaging each other at spaced intervals to form a series of annular spaces;

an upstream primary inlet for fluids to enter a first of the series of annular spaces;

a drive unit rotating the rotor such that, as the rotor rotates, fluids are drawn through the upstream primary inlet and the series of annular spaces between the rotor and the stator;

a portion of the rotor comprising a central flow passage extending from a downstream secondary inlet spaced downstream from the upstream primary inlet to the upstream primary inlet; and a flow diversion unit for diverting a portion of the fluids being pumped into the downstream secondary inlet such that said fluids pass under pressure through the central flow passage of the rotor to the upstream primary inlet and wash accumulated solids from the upstream primary inlet.

2. A moineau pump assembly, comprising:

a stator;

a rotor extending through the stator, the rotor and stator sealingly engaging each other at spaced intervals to form a series of annular spaces;

an upstream primary inlet for fluids to enter a first of the series of annular spaces;

a drive unit rotating the rotor such that, as the rotor rotates, fluids are drawn through the upstream primary inlet and the series of annular spaces between the rotor and the stator;

a portion of the rotor comprising a central flow passage extending from a downstream secondary inlet spaced downstream from the upstream primary inlet to the upstream primary inlet; and an orbiting drive for diverting a portion of the fluids being pumped into the downstream secondary inlet, the orbiting drive having a plurality of radially extending forwardly angled vanes, such that as the rotor rotates the rotary motion of the vanes exerts pressure to direct fluids into the downstream secondary inlet, such that said fluids pass under pressure through the central flow passage of the rotor to the upstream primary inlet and wash accumulated solids from the upstream primary inlet.

3. A method of washing accumulated solids from an upstream primary inlet of a moineau pump assembly, the moineau pump assembly comprising a stator and a rotor sealingly engaging each other at spaced intervals to form a series of annular spaces, comprising the steps of:

(a) rotating the rotor using a drive unit to draw fluids under pressure through an upstream primary inlet and the series of annular spaces of the moineau pump assembly;

(b) redirecting a portion of the fluids using a flow diversion unit adjacent the series of annular spaces, such that the portion of the fluids is redirected in an upstream direction;

(c) diverting the portion of the fluids in an upstream direction through a central flow passage disposed within the rotor; and (d) directing the portion of the fluids to exit the central flow passage adjacent the upstream primary inlet.

* * * * *